United States Patent [19]

Christophorou et al.

[11] Patent Number: 4,792,724

[45] Date of Patent: Dec. 20, 1988

[54] GAS MIXTURES FOR SPARK GAP CLOSING SWITCHES

[75] Inventors: Loucas G. Christophorou, Oak Ridge; Dennis L. McCorkle, Knoxville; Scott R. Hunter, Oak Ridge, all of Tenn.

[73] Assignee: The United States of America as represented by the United States Department of Energy, Washington, D.C.

[21] Appl. No.: 16,904

[22] Filed: Feb. 20, 1987

[51] Int. Cl.[4] ..... H05B 37/02

[52] U.S. Cl. ..... 313/637; 313/643

[58] Field of Search ..... 313/637, 589, 231.01, 313/643; 315/150, 358; 174/17 GF

[56] References Cited

U.S. PATENT DOCUMENTS

| | | | |
|---|---|---|---|
| 2,853,540 | 9/1958 | Camilli et al. | 174/17 |
| 2,867,679 | 1/1959 | Cobine | 174/17 |
| 2,886,625 | 5/1959 | Wolfe | 174/15 |
| 2,943,134 | 6/1960 | Liao et al. | 174/16 |
| 4,077,020 | 2/1978 | Anderson et al. | 313/231.01 X |
| 4,257,905 | 3/1981 | Christophorou et al. | 252/571 |
| 4,490,650 | 12/1984 | Christophorou et al. | 315/150 |
| 4,498,183 | 2/1985 | Levatter et al. | 313/231.41 X |

OTHER PUBLICATIONS

Nakanishi et al.; "Penning Ionization Ternary Gas Mixtures for Diffuse Switching Applications" 7/15/1985, J. Appl. Phys., pp. 633–641.

W. D. Kimura et al., "Spark Columns in High Power Preionization Triggered Switches", Jun. 25, 1985.

*Primary Examiner*—David K. Moore

*Assistant Examiner*—K. Wieder

*Attorney, Agent, or Firm*—Katherine P. Lovingood; Stephen D. Hamel; Judson R. Hightower

[57] ABSTRACT

Gas mixtures for use in spark gap closing switches comprised of fluorocarbons and low molecular weight, inert buffer gases. To this can be added a third gas having a low ionization potential relative to the buffer gas. The gas mixtures presented possess properties that optimized the efficiency spark gap closing switches.

6 Claims, 6 Drawing Sheets

GAS MIXTURES FOR SPARK GAP CLOSING SWITCHES

This invention relates to gas mixtures that improve the performance of spark gap closing switches and was developed pursuant to a contract with the United States Department of Energy. These switches are crucial elements of many advanced technologies involving laser and pulse power applications.

A spark gap switch can be described in a most basic manner as a pair of electrodes with a gas between them that can sustain a voltage across the electrodes that is near that of the breakdown voltage of the gas. If a gas has good electron attachment capability, it can sustain a high voltage making it a good insulator when the switch is open. The same gas, to be efficient in a spark gap closing switch, must free up electrons when the switch is closed making it a good conductor in the closed phase. Therefore, there is a need for gas mixtures that are both good insulators when the spark gap closing switch is open and good conductors when closed.

SUMMARY OF THE INVENTION

In view of the above need it is an object of this invention to provide gas mixtures that improve the efficiency of spark gap closing switches.

Another object of this invention is to provide gas mixtures that are good insulators when spark gap switches are open.

A third object of this invention is to provide gas mixtures that are good conductors when spark gap closing switches are closed.

It is also an object of this invention to provide gas mixtures that have good electron attachment characteristics at ambient temperatures.

Another object of this invention is to provide a gas mixture that frees attached electrons at high temperatures.

A final object of this invention is to provide a spark gap closing switch having improved efficiency, repetition rate and recovery characteristics. Other objects and advantages will become apparent to persons skilled in the art upon study of the specifications and appended claims.

To achieve the foregoing and other objects in accordance with the purpose of the present invention, the gas mixture of this invention may comprise a gas component that strongly attaches electrons at low energies, said attachment being exclusively nondissociative, and detaches from electrons as energy increases. Many fluorocarbons have these electron attachment and detachment characteristics and a number of them such as $C_6F_6$, 1-$C_3F_6$, n-$C_4F_{10}$, $C_3F_8$, c-$C_4F_8$, c-$C_4F_6$, or c-$C_5F_{10}$ have proven to be effective. If fluorocarbons comprise the gas component, it is necessary to dilute it with a second component because the spark will cause decomposition of the gas and carbon can deposit in the switch. Another reason to add the second component is to increase the electron drift velocity in the system which thereby increases the conductivity of the gas mixture. A suitable second component is one that has low molecular weight and is nonreacting, such as an inert gas or a diatomic gas.

The invention is also a ternary gas mixture comprising a fluorocarbon, a second gas that is nonreactive and of low molecular weight and a third gas that has a low ionization potential relative to the second gas component.

The invention is also a spark gap closing switch that has a gas mixture between the switch electrodes that strongly attaches electrons at low energies, said attachment being exclusively nondissociative, and detaches from electrons as energy increases.

The gas mixtures described by the specifications of this application can go from a good insulator to a good conductor rapidly at breakdown voltage. This property is found in some gases that attach electrons to form negatively charged gas molecules instead of dissociating into positive fragments and electron pairs.

DETAILED DESCRIPTION OF THE PREFERRED EMBODIMENT

Figure 1:
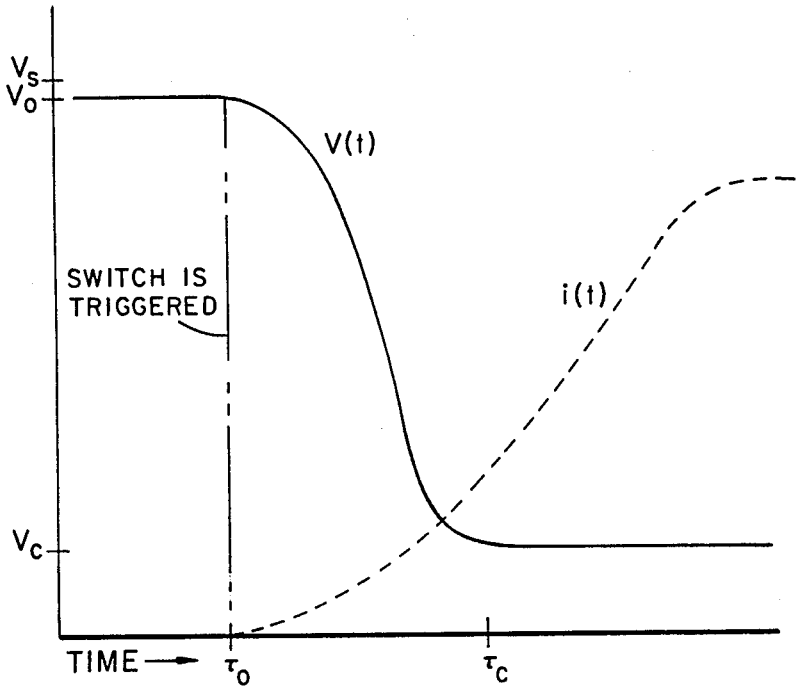
FIG. 1 is a graph showing the relationship of voltage (V) and current (i) with time (t) in a spark gap closing switch.

When a spark gap closing switch is in the open phase, there is a high sustained voltage across the electrodes approaching the breakdown voltage of the gas as shown in FIG. 1. $V_o$ represents the sustained voltage and $V_s$ represents the breakdown voltage. To maximize the speed of closing, thereby maximizing the efficiency of the switch, it is necessary to approach $V_c$, the voltage during the conducting phase, as rapidly as possible. The gas must transform from one that is a good insulator to one that is a good conductor in a minimum of time. It is also desirable for $V_o$ to be very near the breakdown voltage while $V_c$ is as low as possible.

In the open phase, when the gas must insulate, electron attachment is an important characteristic; therefore the gas mixture must be able to tie up the electrons that are present in a system that has a high electric field. A suitable type gas would be one that forms negatively charged aolecules, i.e., $AX^-$.

The switch is closed by introducing energy using a laser trigger or other triggering device that will induce voltage breakdown. When this occurs at time, $t_o$, the gas must release electrons when the voltage, V(t), begins to drop. Such a gas must have an electron attachment rate that decreases with increasing temperature since the temperature will increase at breakdown when the current, i(t), begins to flow. It must also not dissociate into positively charged molecular fragments and electron pairs. There are few gases that possess all these characteristics and applicants have identified the following that meet the criterion of the invention: $C_6F_6$, 1-$C_3F_6$, n-$C_4F_{10}$, $C_3F_8$, c-$C_4F_6$, c-$C_4F_8$, and c-$C_5F_{10}$. When diluted by the addition of a nonreactive gas having low molecular weight, the electron drift velocity increases and conductivity is improved, resulting in a more efficient switch having better repetition rate and recovery characteristics.

It is very important to remember that electron attachment must go down with an increase of energy (temperature) in the system. Without this characteristic, the conductivity would suffer and the switch would be less efficient. Examples of gases that have good electron attachment properties at low energy are known, but their behavior at high temperatures is unpredictable.

It is believed that the efficiency of the switch could be further improved by addition of a small amount of a gas having a low ionization potential resulting in an increase in the number of free electrons in the switching mechanism during the conducting phase. This phenomenon, which is briefly explained here, is more fully discussed in applicants' patent application Ternary Gas Mixtures for Diffuse Discharge Switch S.N. 884,857 filed on July 14, 1986. When the system experiences breakdown, the released energy can elevate gas atoms to higher energy states when electrons are excited to higher electron shells but not fully released. Excited electrons continuously return to the groundstate and emit photons which may be resonantly reabsorbed by other atoms; therefore, the gas is in a constant state of absorbing and emitting photons when the switch is closed. The energy in the system incidental to this continuous photon emission does not contribute to the efficiency of the system and is wasted. However, it has been found under similar circumstances that a gas having a low ionization potential can capture this energy and become ionized to release electrons and significantly increase the electron density in the switch.

EXAMPLE

Various mixtures of gases having good nondissociative electron attaching properties were tested to compare their attachment rate with electron energy. Although actual switch measurements were not taken, the relationship of attachment rate and electron energy is indicative of suitable gas mixtures for use in spark gap closing switches, see FIGS. 2 through 6.

Figure 2:
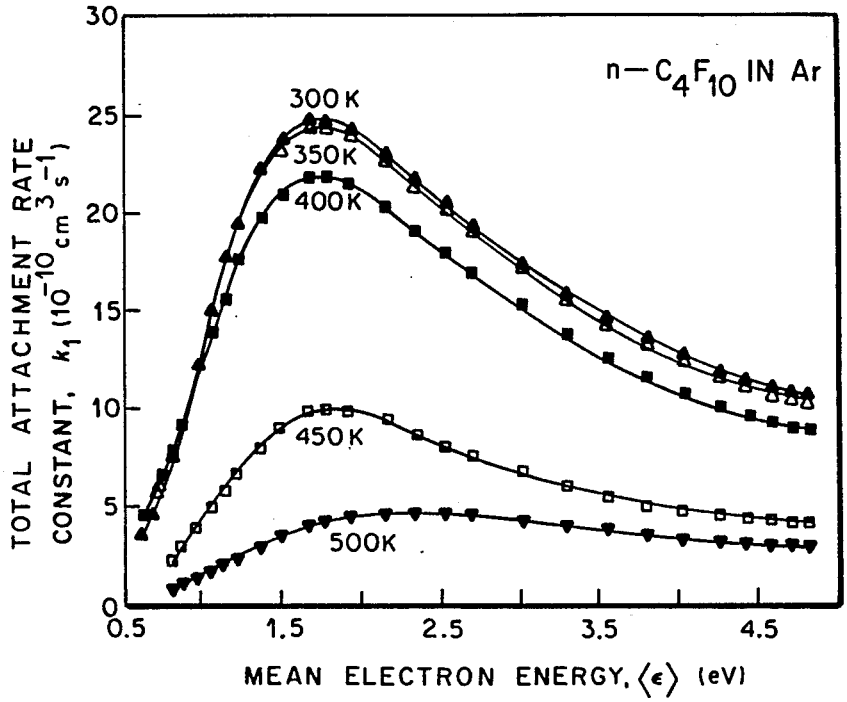
FIGS. 2 through 6 are graphs showing the relationship of electron attachment rate and mean electron energy at different temperatures for various gas mixtures.
Figure 3:
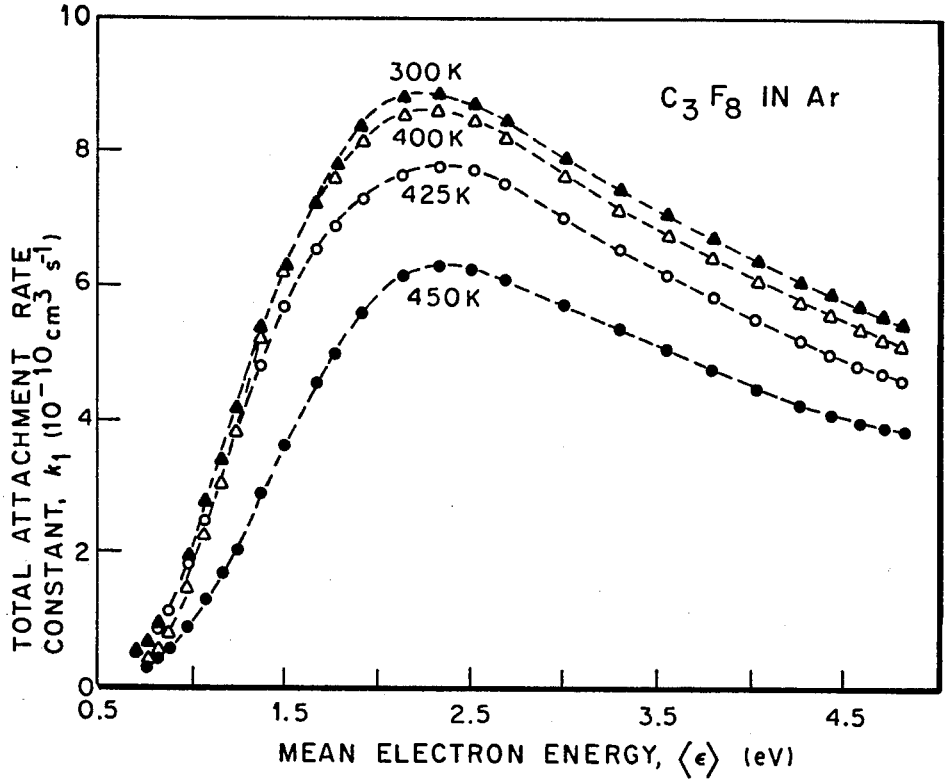

FIG. 2 shows a maximum attachment rate for n-$C_4F_{10}$ in Ar at about 300° C. which drops as the temperature increases to 500° K. A similar behavior is shown in FIG. 3 for $C_3F_8$ in Ar. It was found that above 500° K. the attachment rate of these two gas mixtures increased, therefore, for these mixures it is necessary that the temperature be maintained at 500° K. or less when the switch is closed.

Figure 4:
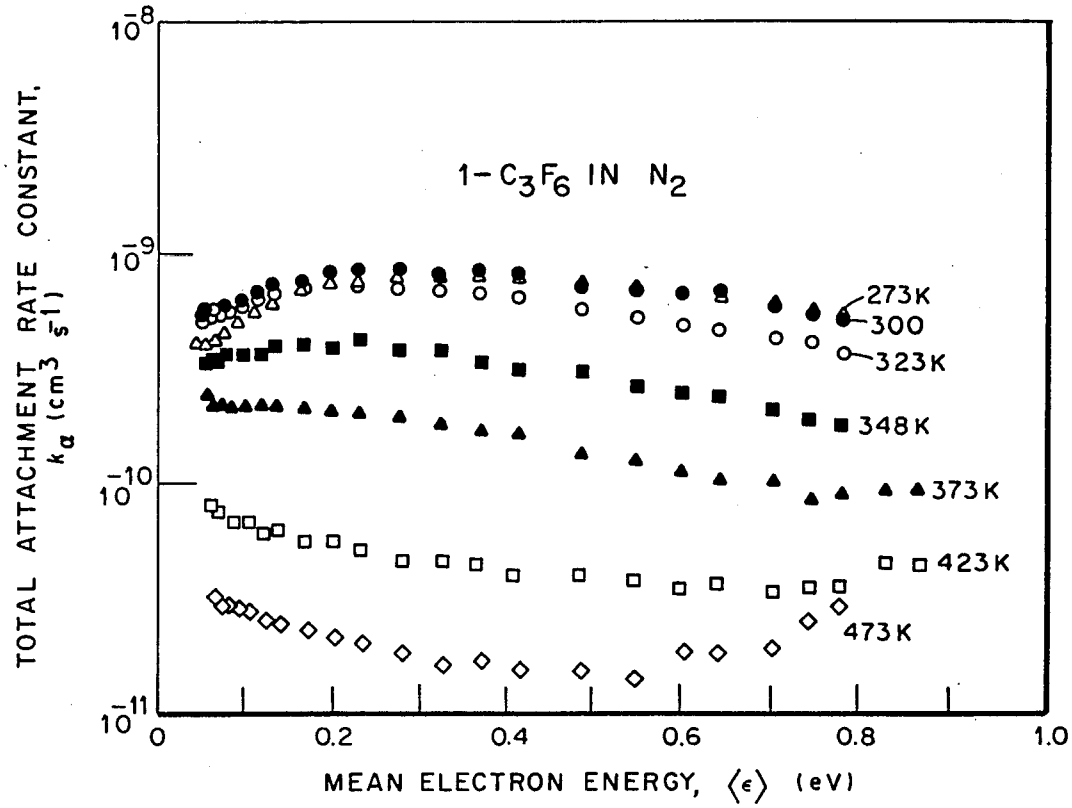
Figure 5:
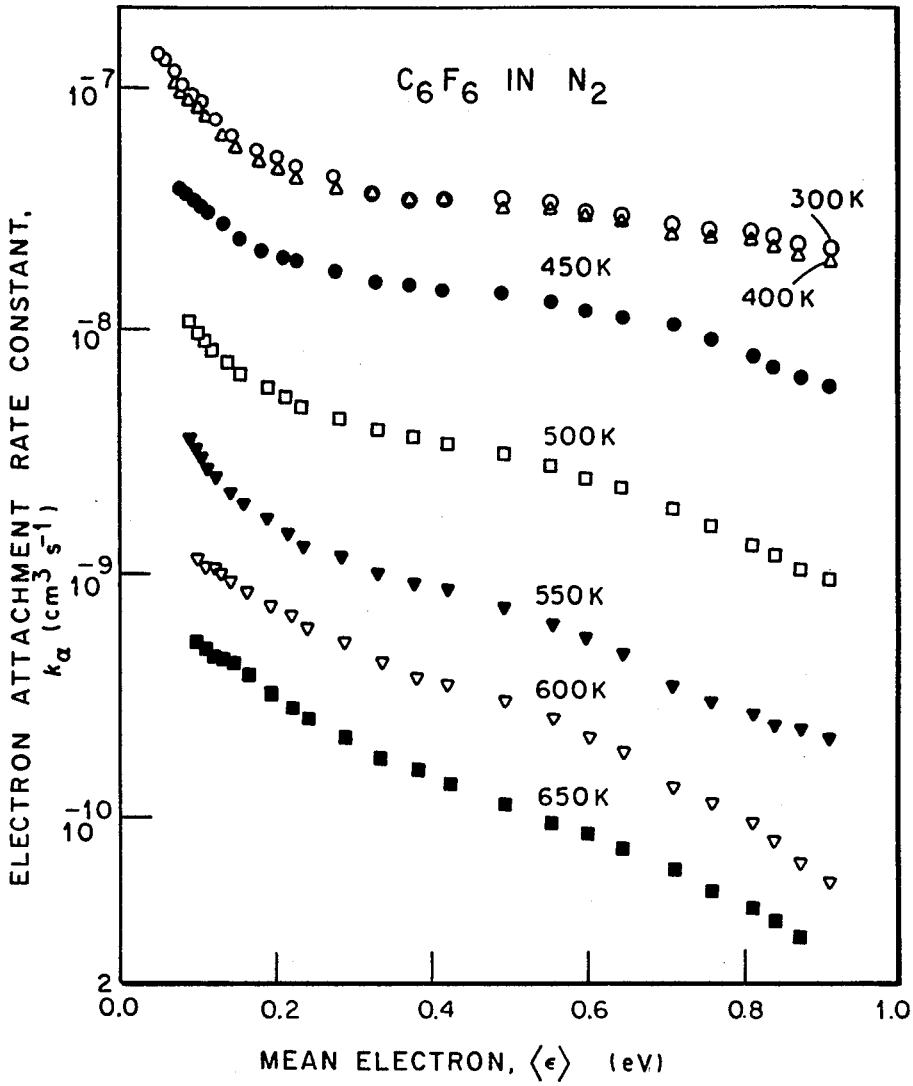
Figure 6:
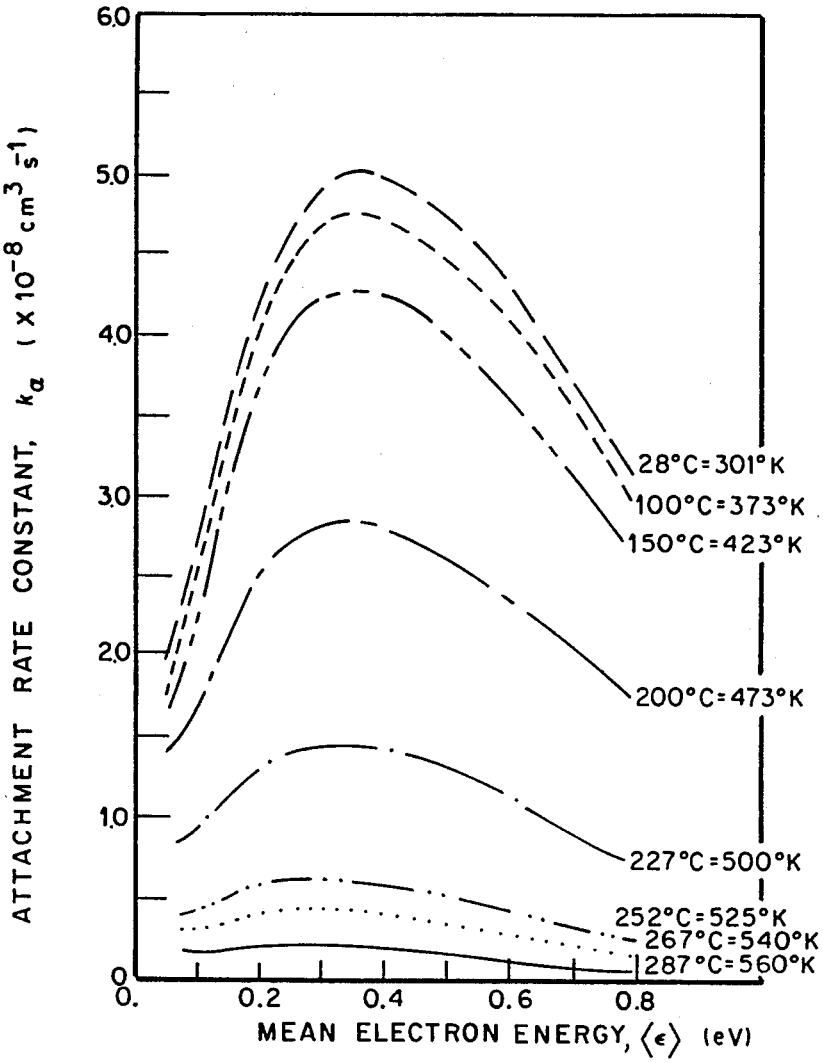

For the other gas mixtures shown in FIGS. 4 through 6, no temperature limitation was demonstrated and attachment rate continued to decrease to the maximum temperature that was measured in each instance.

The binary gas mixtures found suitable comprise from about 2 percent to about 20 percent fluorocarbon in a nonreacting buffer gas of helium, argon, hydrogen or nitrogen. The ternary gas mixtures comprise from about 2 percent to 20 percent fluorocarbon, 0.5 percent to 2 percent low ionization potential additive and the remainder is buffer gas. The amount of low ionization potential additive is a projection based on previous findings as described in the patent application Ser. No. 884,857 filed by inventors on July 14, 1986. Although the gas mixtures tested comprised only one gas from each catagory of fluorocarbon, buffer, or low ionization additive, the gas mixtures could also comprise combinations of gases in any one catagory and still be functional, although no particular advantage is forseen in such combinations.

Therefore, based on the above data and considerations, the following gaseous media possess the most favorable properties for use in closing switches.

GAS MIXTURES FOR CLOSING SWITCHES

Binary Gas Mixtures
- I. 2–20% Fluorocarbon
  - c-$C_4F_6$
  - c-$C_4F_8$
  - $C_3F_8$
  - $C_6F_6$
  - 1-$C_3F_6$
  - n-$C_4F_{10}$
  - c-$C_5F_{10}$
- II. Balance Buffer Gas
  - Argon
  - Helium
  - Hydrogen
  - Nitrogen Ternary Gas Mixtures
- I. 2–20% Fluorocarbon
  - $C_3F_8$
  - n-$C_4F_{10}$
  - c-$C_4F_8$
  - 1-$C_3F_6$
  - c-$C_5F_{10}$
  - c-$C_4F_6$
  - $C_6F_6$
- II. 0.5–2% Low Ionization Additive
  - $C_2H_2$
  - 20$C_4H_8$
- III. Balance Buffer Gas
  - Argon
  - Helium
  - Hydrogen
  - Nitrogen

We claim:

1. A spark gap closing switch having two electrodes and disposed between said electrodes of said switch a gas mixture comprising a first gas component that attaches strongly to electrons at low energies, said attachment being exclusively nondissociative and decreasing with increasing gas temperature, and a second gas component that has low molecular weight, is nonreacting and increases the electron drift velocity within said switch.

2. The spark gap closing switch of claim 1 wherein said first gas component is selected from the group $C_6F_6$, 1-$C_3F_6$, n-$C_4F_{10}$, $C_3F_8$, c-$C_4F_6$, c-$C_4F_8$ and c-$C_5F_{10}$ or combinations thereof, and said second gas component is selected from the group He, Ar, $H_2$ and $N_2$ or combinations thereof.

3. The spark gap closing switch of claim 2 wherein said first gas component is present in an amount from about 2 to 20 percent.

4. A spark gap closing switch of claim 1 wherein said gas mixture further comprises a third gas that has a low ionization potential relative to said second gas component.

5. The spark gas closing switch of claim 4 wherein said third gas component is selected from the group $C_2H_2$ and 2-$C_4H_8$ or combinations thereof.

6. The spark gap closing switch of claim 5 wherein said third gas component is present in the amount from about 0.5 to 2 percent.

* * * * *